US012601223B2

(12) United States Patent
Wachinger et al.

(10) Patent No.: US 12,601,223 B2
(45) Date of Patent: Apr. 14, 2026

(54) DRILLING ASSEMBLY

(71) Applicant: BAUER Spezialtiefbau GmbH, Schrobenhausen (DE)

(72) Inventors: Matthias Wachinger, Aichach-Oberbernbach (DE); Martin Mussack, Freising (DE)

(73) Assignee: BAUER Spezialtiefbau GmbH, Schrobenhausen (DE)

( * ) Notice: Subject to any disclaimer, the term of this patent is extended or adjusted under 35 U.S.C. 154(b) by 0 days.

(21) Appl. No.: 18/871,004

(22) PCT Filed: May 23, 2023

(86) PCT No.: PCT/EP2023/063753
§ 371 (c)(1),
(2) Date: Dec. 2, 2024

(87) PCT Pub. No.: WO2024/017523
PCT Pub. Date: Jan. 25, 2024

(65) Prior Publication Data

US 2025/0341132 A1 Nov. 6, 2025

(30) Foreign Application Priority Data

Jul. 20, 2022 (EP) ..... 22186019

(51) Int. Cl.
*E21B 6/04* (2006.01)
*E21B 4/14* (2006.01)
(Continued)

(52) U.S. Cl.
CPC ..... *E21B 6/04* (2013.01); *E21B 4/14* (2013.01); *E21B 17/03* (2013.01); *E21B 17/07* (2013.01); *E21B 17/076* (2013.01); *E21B 7/046* (2013.01)

(58) Field of Classification Search
CPC ..... E21B 4/14; E21B 17/076; E21B 6/04
See application file for complete search history.

(56) References Cited

FOREIGN PATENT DOCUMENTS

DE 1 220 360 B 7/1966
DE 2155540 A1 * 5/1973
(Continued)

OTHER PUBLICATIONS

International Search Report issued in PCT/EP2023/063753; mailed Jul. 6, 2023.
(Continued)

*Primary Examiner* — Giovanna Wright
(74) *Attorney, Agent, or Firm* — Studebaker Brackett PLLC

(57) ABSTRACT

The invention relates to a drilling assembly for earth or rock drilling, comprising an inner rod, which comprises, at its distal end facing the ground, an inner drilling tool for removing ground material, and which can be connected, at its proximal end, to a rotary drive for the transmitting a drilling torque, a tubular outer rod, which surrounds the inner rod and comprises, at its distal end, an annular drill bit for removing ground material, and an impact unit, which is arranged on the inner rod in the region of the distal end and is configured to exert axially directed impacts on the inner drilling tool, wherein, in the region of the distal end, a radial connecting apparatus is arranged and configured between the inner rod and the outer rod, which connecting apparatus allows torque to be transmitted from the rotationally driven inner rod to the drill bit of the outer rod. According to the invention, it is provided that a telescopic connecting unit is arranged on the inner rod and is configured to allow torque to be transmitted between the distal end of the inner rod and the proximal end of the inner rod, and to allow axial
(Continued)

displacement between the distal end of the inner rod and the proximal end of the inner rod.

14 Claims, 6 Drawing Sheets

(51) Int. Cl.

| | |
|---|---|
| ***E21B 7/04*** | (2006.01) |
| ***E21B 17/03*** | (2006.01) |
| ***E21B 17/07*** | (2006.01) |

(56) References Cited

FOREIGN PATENT DOCUMENTS

| | | |
|---|---|---|
| DE | 198 13 087 A1 | 9/1999 |
| DE | 100 05 475 A1 | 8/2001 |
| EP | 3 128 117 A1 | 2/2017 |

OTHER PUBLICATIONS

International Preliminary Report on Patentability (Chapter I) and Written Opinion of the International Searching Authority issued in PCT/EP2023/063753; issued Dec. 18, 2024.

* cited by examiner

DRILLING ASSEMBLY

TECHNICAL FIELD

The invention relates to a drilling assembly for earth or rock drilling, comprising an inner rod, which comprises, at its distal end facing the ground, an inner drilling tool for removing ground material, and which can be connected, at its proximal end, to a rotary drive for the transmission of a drilling torque, a tubular outer rod, which surrounds the inner rod and comprises, at its distal end, an annular drill bit for removing ground material, and an impact unit, which is arranged on the inner rod in the region of the distal end and is configured to exert axially directed impacts on the inner drilling tool, wherein, in the region of the distal end, a radial connecting apparatus is arranged and configured between the inner rod and the outer rod, which connecting apparatus allows torque to be transmitted from the rotationally driven inner rod to the drill bit of the outer rod.

Furthermore, the invention relates to a method for earth or rock drilling.

BACKGROUND

A drilling assembly for earth or rock drilling is found in DE 10 005 475 A1, for example. This known drilling assembly comprises an inner rod, a hollow outer rod and a rotary device for rotating both rods. In this way, overburden drilling can be carried out, wherein the inner rod can be driven in one rotational direction and the outer rod can be driven in another rotational direction. Furthermore, an impact unit is provided, by means of which impacts can be exerted on the rear end of the inner rod. As a result, good drilling heading can be achieved. In this known drilling assembly, the outer rod is driven by two rotary drives at the proximal end, i.e. at the end remote from the borehole, wherein a torque is transmitted to the inner rod at the proximal end by means of a transmission assembly. The torque thus has to be transmitted through the impact unit to the drilling tool at the distal end of the inner rod, i.e. on the borehole-side end.

It is known to provide a radial connecting apparatus at the distal end of both rods for transmitting torque between the inner rod and the outer rod. This allows for targeted torque transmission behind the impact unit.

In order to reach greater drilling depths, it is necessary to use additional drill rod elements. To do this, the outer rod and the inner rod need to be unfastened from the rotary drive apparatus, displaced axially relative to one another, and additional rod elements need to be screwed on.

In the drilling assembly comprising the radial connecting apparatus on the borehole-side distal end region of the drill rod, problems can arise when inserting or disassembling additional rod elements in terms of this distal connecting apparatus between the inner rod and the outer rod. The connection can come loose, which hinders drilling progress and requires time-consuming readjustment.

SUMMARY

The object of the invention is to provide a drilling assembly and a method for earth or rock drilling by means of which efficient drilling operation is made possible.

The drilling assembly according to the invention is characterized in that a telescopic connecting unit is arranged on the inner rod and is configured to allow torque to be transmitted between the distal end of the inner rod and the proximal end of the inner rod, and to allow axial displacement between the distal end of the inner rod and the proximal end of the inner rod.

A first aspect of the invention resides in that torque transmission is provided from a rotary drive via the inner rod, wherein a radial connecting apparatus is arranged at the distal end of the inner rod. Torque can be transmitted from the inner rod at the distal end to the drill bit of the outer rod via the radial connecting apparatus. Torque is therefore introduced from the inner rod to the outer rod directly on the borehole-side distal end region of the inner rod. This allows for particularly efficient torque transmission. The radial connecting apparatus is preferably configured such that only torque is transmitted, but there exists displaceability in the axial direction. Therefore, transmission of axial forces from the inner rod to the outer rod is completely or largely avoided. As a result, transmission of impact pulses from the inner rod via the outer rod to a rotary drive of the outer rod can be reduced or largely avoided. The rotary drive for the outer rod is an essential requirement for carrying out a screwing movement.

Another aspect of the invention resides in that a telescopic connecting unit is arranged on the inner rod and allows for torque transmission on the inner rod and at the same time for axial displaceability of the inner rod. This makes it possible for the radial connecting apparatus between the inner rod and the outer rod to remain exit at the distal end, even if a new double-pipe rod element comprising an inner rod element and an outer rod element is screwed on to lengthen the drill string and, in the process, the proximal end of the inner rod needs to be displaced relative to the proximal end of the outer rod.

Overall, the drilling assembly according to the invention can thus achieve particularly efficient drilling operation when making a borehole in earth or rock drilling.

In principle, the radial connecting apparatus can be arranged at any suitable point on a distal end region of the inner rod. It is particularly advantageous for the radial connecting apparatus to be arranged behind the impact unit in a drilling direction. In particular, the radial connecting apparatus can be arranged on the outer rod directly in the region of the annular drill bit, in order to allow for a most efficient possible torque transmission. This means that the impact unit is located on the inner rod between the proximal rotary drive and the distal inner drilling tool directed towards the borehole side.

A further advantageous embodiment of the invention resides in that the telescopic connecting unit is arranged in front of the impact unit in a drilling direction. The impact unit is therefore arranged between the distal inner drilling tool and the connecting unit. When the proximal end of the inner rod is displaced axially relative to the outer rod, the displacement movement is taken up and compensated by the telescopic connecting unit, without the impact unit and the radial connecting apparatus following in the drilling direction being displaced in the region of the inner drilling tool and the drill bit. Therefore, the positioning and orientation of the impact unit, the inner drilling tool and the tubular drill bit can be maintained even if additional rod elements having relative displacement of the distal ends of the inner rod and outer rod relative to one another are installed or disassembled.

In principle, the impact unit can be configured in any suitable manner and can be supplied with suitable power, thus, for example with electrical power or hydraulic power. According to a embodiment variant of the invention, it is particularly advantageous for the impact unit to be able to be operated by a pressurized fluid, in particular compressed air. A fluid is a flowable medium and can be a liquid, for example hydraulic liquid, or a gas. In particular, when using compressed air, the expanded air can still be used to transport away the drill cuttings, similarly to an airlifting process.

This embodiment of the invention is advantageously further configured in that the inner rod comprises an inner channel, through which the pressurized fluid can be conducted toward the impact unit. The pressurized fluid, in particular compressed air, can be conveyed through the interior of the inner rod up to the impact unit via a corresponding pressurized fluid supply at the proximal end of the inner rod.

According to an embodiment of the invention, for efficiently discharging the removed ground material it is preferable for the tubular outer rod to be arranged coaxially with the inner rod at a radial distance, wherein an annular channel is formed for discharging removed ground material, in particular by means of the pressurized fluid emerging from the impact unit. In particular, in the case of vertical or substantially vertical drilling, the pressurized fluid can generate an upward fluid flow, such that removed ground material together with surrounding drilling suspension can be discharged through the annular channel, preferably without a pump. An outlet opening out of the annular channel can be arranged on the proximal end of the drill rod, such that the discharged suspension together with the removed ground material can be carried away from the drilling assembly.

In order to transmit the torque from the rotationally driven inner rod to the outer rod, the radial connecting apparatus can in principle be executed in any manner. It is particularly advantageous for the radial connecting apparatus to comprise radially directed catches. These radially directed catches can be constructed similarly to a keyway gearing, such that, during a rotational movement of the inner rod, it can transmit the torque to the outer rod via the sides of the catches, but at the same time axial displaceability is ensured.

A particularly advantageous configuration of the telescopic connecting unit results according to the invention in that the telescopic connecting unit comprises an inner pipe for attachment to a proximal or distal portion of the inner rod and an outer pipe, which can be displaced axially relative thereto and is mounted in a pressure-tight manner, for attachment to a distal or respectively proximal portion of the inner rod, and in that at least one axially displaceable catch element for transmitting torque is arranged between the inner pipe and the outer pipe. In this case, the catch element can likewise comprise one or more radially projecting keys, wherein a keyway-like connection is formed. This allows torque to be transmitted from the outer pipe to the inner pipe, wherein at the same time axial displaceability between the outer pipe and the inner pipe of the connecting unit is provided.

Appropriate sealing of catch element between the outer pipe and the inner pipe can ensure that a pressurized fluid can be conducted on through the inner rod up to the impact unit through the telescopic connecting unit comprising the tubular elements.

According to a continuing configuration of the invention, for making particularly deep drill holes, it is preferable for the inner rod and the outer rod to each comprise, at their proximal ends, threaded portions, which are configured for screwing on additional rod elements. Preferably, the individual rod elements themselves comprise compatible threaded portions at their end regions, such that, depending on the number of rod elements to be screwed on, almost any length of the inner rod and outer rod can be implemented.

In particular, during the screwing movement required for installing and detaching the individual rod elements and axial displacement movements, the telescopic connecting unit on the inner rod does not allow the axial movement to be transmitted to the distal end of the inner rod. In terms of axial displaceability, the telescopic connecting unit results in the distal end portion of the inner rod being uncoupled from the proximal end portion of the inner rod. In this case, an axial displacement movement can, in particular be brought about by a displaceable rotary drive for the inner rod. Here, the rotary drive can be arranged on an adjustable slide.

An advantageous embodiment variant of the drilling assembly according to the invention resides also in that a drilling device comprising a first rotary drive for applying the drilling torque for drilling to the inner rod and a second rotary drive for applying a rotational movement for screwing to the outer rod is arranged. In this drilling assembly, the drilling torque is therefore applied to the inner rod by the first rotary drive. The drilling torque can be transmitted to the outer rod by means of the radial connecting apparatus at the distal end of the inner rod, and indeed direct in the vicinity of the distal end of the outer rod comprising the drill bit.

The drilling assembly can further comprise a second rotary drive for the outer rod. However, the second rotary drive is usually not used to apply a drilling torque to the outer rod. Instead, the second rotary drive serves essentially to apply a screwing movement to the outer rod when an outer rod element is being screwed on or unscrewed.

Respectively, at least one clamping apparatus, preferably also two clamping apparatuses, for the inner rod and the outer rod can also be arranged on the drilling assembly for fixing and holding the rod in question. This allows for efficient screwing in conjunction with the first rotary drive or the second rotary drive. The clamping apparatus can be configured to be clamp-like or chuck-like and to be pivotable, such that the thread can also be broken by means of the pivotable clamping apparatus when unfastening a rod element.

In this case, an expedient configuration can reside in that an axial compensation/decoupling element for compensating for an axial change in length during screwing and/or for axially decoupling the second rotary drive from the outer rod is arranged on the second rotary drive. When using a rotary drive, a rotational movement alone is not sufficient, since, depending on the pitch of the thread, theretakes place always a certain axial displacement during the screwing. Suchlike combination of the rotational movement of the rotary drive with the required axial movement can be implemented by a compensation element, which can preferably be constructed to be telescopic. By means of the axial compensation/decoupling element, during drilling, transmission of axial impacts or vibrations from the outer rod to the second rotary drive can also be damped or prevented.

In particular, according to a continuing configuration of the invention, it is advantageous for the drilling device to comprise a thread-breaking apparatus having at least one first collet chuck for the inner rod and at least one second collet chuck for the outer rod. Two collet chucks can also be provided for the inner rod and/or the outer rod. As a result, large torques can also be applied by pivoting the collet chucks relative to one another to unfasten a tightened threaded connection. The collet chucks can be part of the at least one clamping apparatus.

The invention further comprises a method for earth or rock drilling, which is characterized in that a drilling assembly according to the invention is used. In the method, the above-described advantages can be achieved when using the drilling assembly.

A preferred method variant of the invention resides in that the inner rod and the outer rod are lengthened and shortened by attaching and/or detaching a rod element, wherein the proximal end of the inner rod is axially moved relative to the proximal end of the outer rod by an adjustment length, wherein the adjustment length is shorter than or equal to a telescoping length of the telescopic connecting unit, such that a connection via the radial connecting apparatus at the distal end of the inner rod and the drill bit at the distal end of the outer rod persists. In this case, it is provided to attach and detach additional rod elements in a simple manner without impairing the existing radial connection at the distal end of the inner rod and the outer rod.

Another method variant of the invention resides in that an axial compensation/decoupling element is arranged between the second rotary drive and the outer rod, wherein, during drilling, transmissing of axial impacts or vibrations from the outer rod to the second rotary drive is damped or prevented. In particular, the inner rod can be operated by impact pulses of the impact unit. Said pulses can be transmitted to the distal portion of the outer rod in full or in part. Transmission of the impact pulses or vibrations to the second rotary drive is counteracted by the axial compensation/decoupling element, for example a telescopic sliding sleeve. This reduces the wear of the drive.

BRIEF DESCRIPTION OF THE DRAWINGS

The invention is described in greater detail in the following with reference to preferred exemplary embodiments, which are shown schematically in the drawings, in which show.

DETAILED DESCRIPTION

Figure 1:
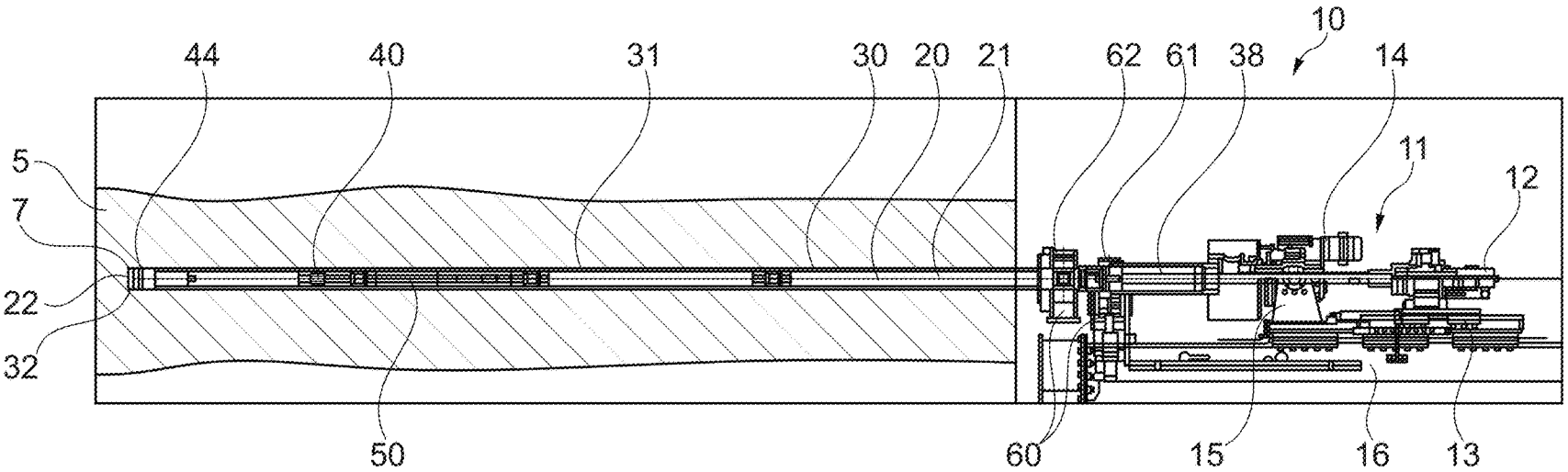
FIG. 1 a schematic partial cross section of a drilling assembly according to the invention during drilling.
Figure 2:
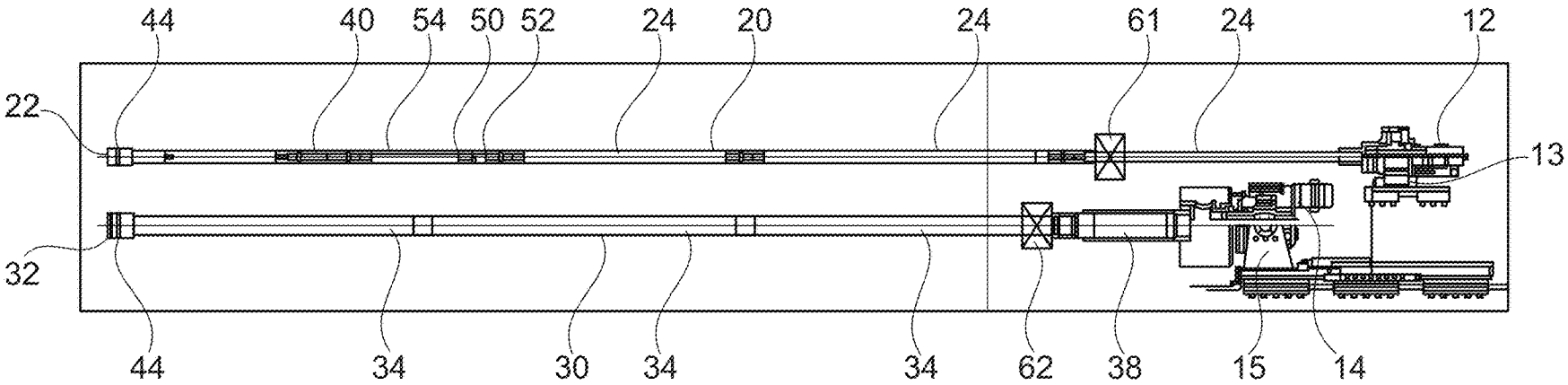
FIG. 2 a schematic view corresponding to FIG. 1, but with the inner rod comprising the rotary drive for the inner rod being separated from the outer rod comprising the rotary drive intended therefor.

From FIGS. 1 and 2 arise a drilling assembly 10 according to the invention comprising a drilling device 11 having a first rotary drive 12 for an inner rod 20 and a second rotary drive 14 for an outer rod 30. FIG. 1 shows the drilling assembly 10 in an assembled state. For better illustration, the schematic FIG. 2 shows the inner rod 20 comprising the first rotary drive 12 separately and offset upwards.

The first rotary drive 12 for the inner rod 20 is arranged on a first drill slide 13 and is mounted so as to be linearly displaceable in the drilling direction along a carriage 16 of the drilling device 11. The second rotary drive 14 is mounted on a second drill slide 15 in the drilling direction behind the first rotary drive 12 so as to likewise be axially displaceable in the drilling direction on the carriage 16. The displacement is performed by means of corresponding linear drives, in particular by means of hydraulic actuating cylinders. The first drill slide 13 can be mounted so as to be displaceable on the second drill slide 15.

The second rotary drive 14 is connected to the tubular outer rod 30 via a tubular and telescopic compensation element 38. An annular drill bit 32 for removing ground material is arranged at the distal end of the outer rod 30. The likewise tubular inner rod 20 comprising an inner channel 21 is arranged coaxially within the tubular outer rod 30. The inner rod 20 is guided through the second rotary drive 14 at the proximal end and is rotationally connected to the first rotary drive 12.

An inner drilling tool 22 for removing ground material is arranged at the distal end of the inner rod 20.

A radial connecting apparatus 44 is arranged at the distal end of the inner rod 20 and the outer rod 30 close to the inner drilling tool 22 or respectively the drill bit 32, by means of which connecting apparatus torque can be transmitted from the inner rod 20 to the outer rod 30 comprising the drill bit 32. In the exemplary embodiment of a drilling assembly 10 according to the invention that is shown, the torque for drilling is essentially generated by the first rotary drive 12 for the inner rod 20 and is transmitted to the outer rod 30 via the distal radial connecting apparatus 44. In the example shown, the second rotary drive 14 for the outer rod 30 serves to hold and displace the outer rod 30 as well as to apply a screwing movement to the outer rod 30.

An impact unit 40 is arranged in a distal end portion of the inner rod 20. In the present exemplary embodiment, the impact unit 40 is supplied with compressed air via the inner channel 21 of the inner rod 20. By means of the impact unit 40, the distal end portion of the inner rod 30 is set into impact movement, such that rotary percussion drilling can be performed using the inner drilling tool 22. Owing to the axial displaceability of the drill bit 32 relative to the inner drilling tool 22, wherein only a drilling torque can be transmitted by the radial connecting apparatus 44, the impact movement is not transmitted to the drill bit 32.

By using the drilling assembly 10, a borehole 7 can be made in a ground 5 by removing ground material. The ground material removed by the inner drilling tool 22 and the drill bit 32 can be guided out of the ground 5 together with surrounding drilling suspension through an annular channel 31. The annular channel 31 is formed by an annular clearance, which is formed between the tubular outer rod 30 and the inner rod 20, which has a defined smaller diameter and is arranged coaxially therein.

Drilling suspension can be supplied up to the distal end of the borehole 7 from the drilling device 11 via the inner channel 21 through a corresponding line.

The consumed compressed air flowing out of the impact unit 40 can be co-carried away through the annular channel 31, wherein the compressed air contributes to transporting away the drill cuttings together with the surrounding drilling suspension in accordance with an airlifting process.

A thread-breaking apparatus 60 having a first collet chuck 61 for clamping the inner rod 20 and a second collet chuck 62 for clamping the outer rod 30 is also arranged on the drilling device 11.

According to the invention, a telescopic connecting unit 50 comprising an inner pipe 52 and an outer pipe 54 that is displaceable relative thereto is arranged on the inner rod 20, preferably on a distal end portion, as is to take from FIG. 2. In the specifically shown exemplary embodiment, the telescopic connecting unit 50 is arranged in front of the impact unit 40 in drilling direction, i.e. between the impact unit 40 and the first rotary drive 12.

The telescopic connecting unit 50 secures the axial relative position of the inner drilling tool 22 relative to the drill bit 32 and in particular the radial connecting apparatus 44, in particular when the proximal ends of the inner rod 20 are displaced relative to the outer rod 30 for attaching a new rod element, as arises in greater detail from FIGS. 3 to 12.

Figure 3:
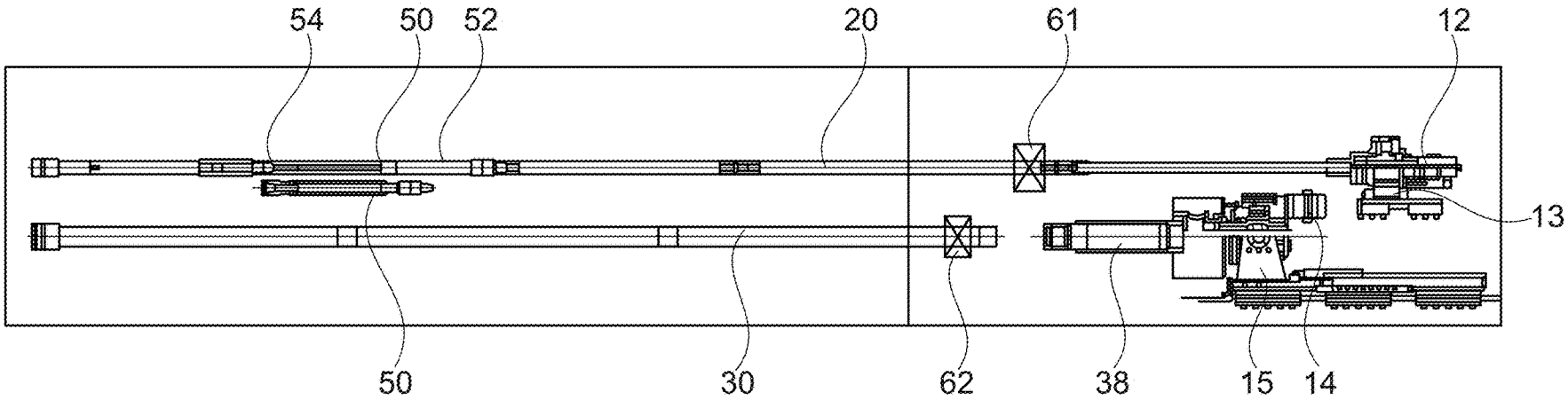
FIGS. 3 to 12 views corresponding to FIG. 2 of the drilling assembly in different states when installing an additional double-pipe rod.

In order to lengthen the inner rod 20 and the outer rod 30, the outer rod 30 is first clamped using the second collet chuck 62 and fixed in position. The threaded connection between the tubular compensation element 38 and the distal end of the outer rod 30 can now be unfastened by the second rotary drive 14, as shown in FIG. 3. When the second rotary drive 14 is slid backwards together with the second drill slide 15, as is required here, the first rotary drive 12 is also moved axially backwards by an adjustment length together with the first drill slide 13. In this process, according to the invention, this displacement movement can be taken up by the telescopic connecting unit 50, wherein the inner pipe 52 is pushed out of the outer pipe 54, as shown schematically in FIG. 3. The connecting unit has a telescoping length that corresponds at least to the adjustment length.

The positions of the distal ends of the inner rod 20 and the outer rod 30 and therefore the connecting apparatus 44 can remain unchanged in this process. Then, in the position according to FIG. 3, the partially pulled-out inner rod 20 can be securely clamped by the first collet chuck 61 and the threaded connection can be unfastened by accordingly rotationally driving the first rotary drive 12.

Figure 4:
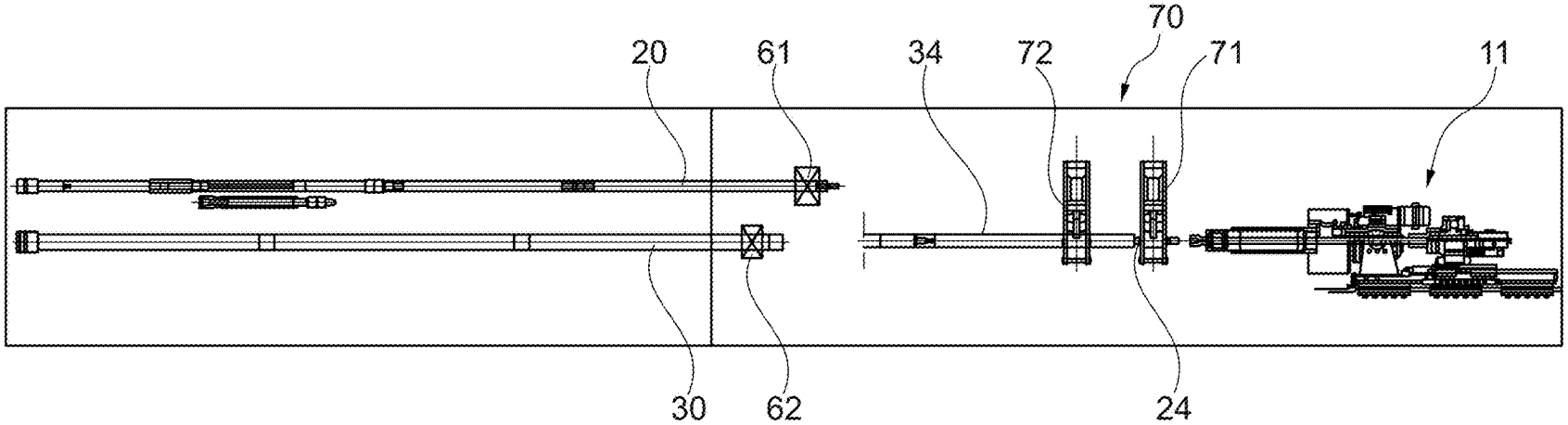

The drilling device 11, which has thus been detached from the inner rod 20 and the outer rod 30, can now be moved backwards to such an extent that a handling apparatus 70 comprising a first holding chuck 71 for a new inner rod element 24 and a second holding chuck 72 for a new outer rod element 34 can be inserted into the region of the drilling axis, as is shown in FIG. 4. Here, the inner rod element 24 and the outer rod element 34 are axially pushed into one another to a large extent and form a double rod element.

Figure 5:
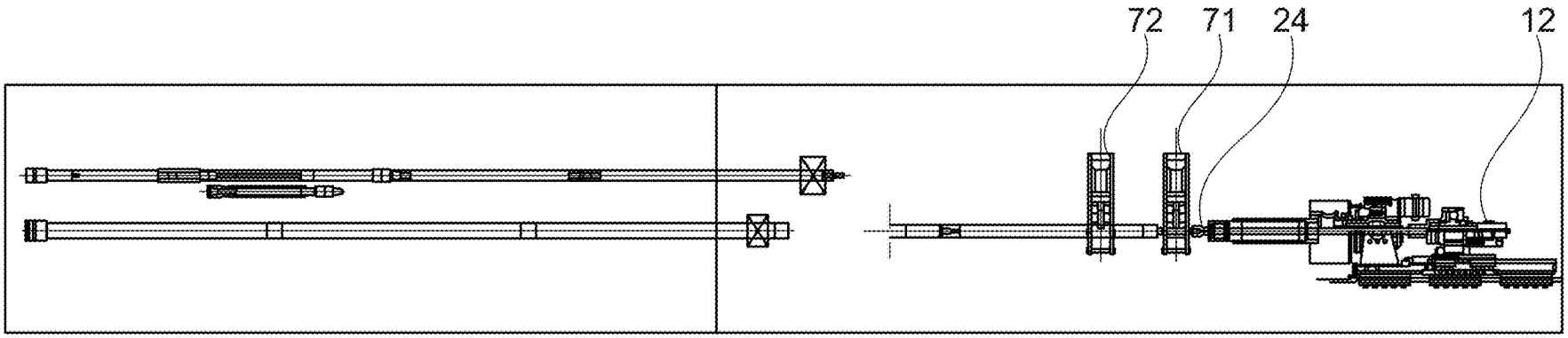
Figure 6:
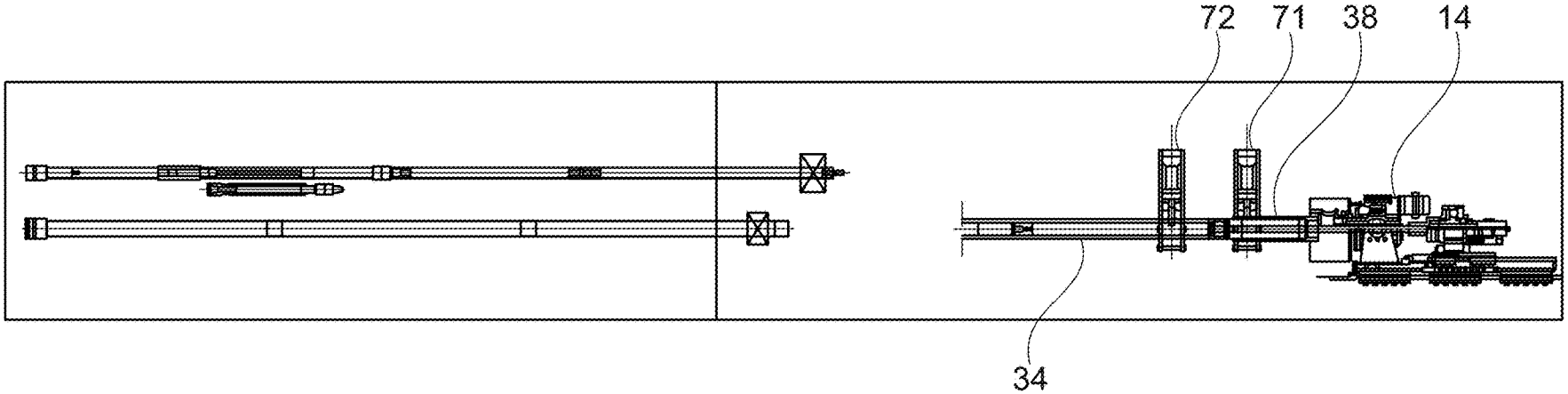

The new inner rod element 24 can then be screwed on by using the first rotary drive 12, as indicated in FIG. 5. In a corresponding manner, the new outer rod element 34 can then be screwed to the compensation element 38 by means of the second rotary drive 14, as shown in FIG. 6.

Figure 7:
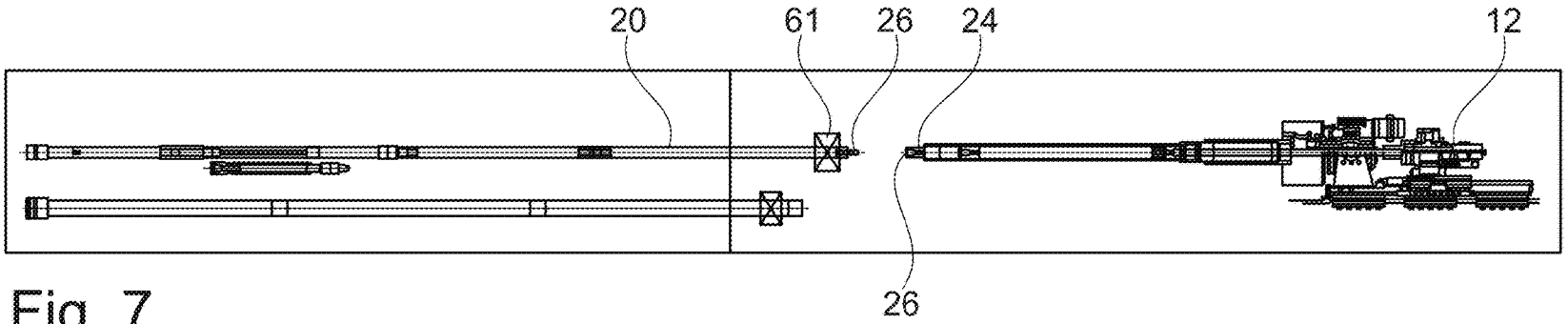
Figure 8:
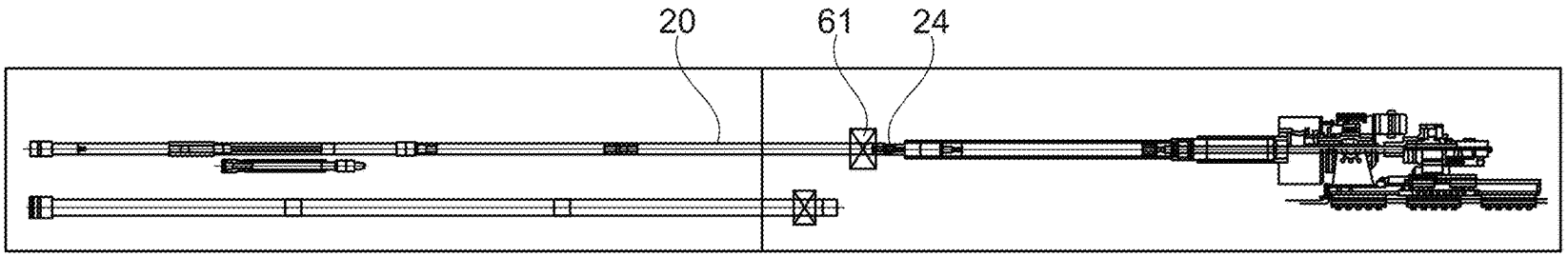
Figure 9:
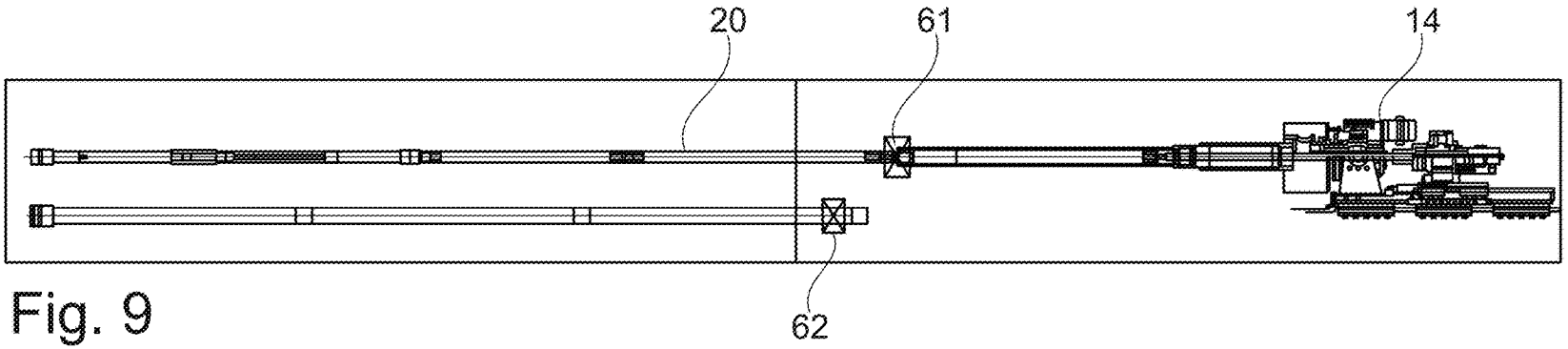

The new inner rod element 24 is then screwed to the inner rod 20 held on the first collet chuck 61 by threaded portions 26, as shown in FIGS. 7 to 9.

Figure 10:
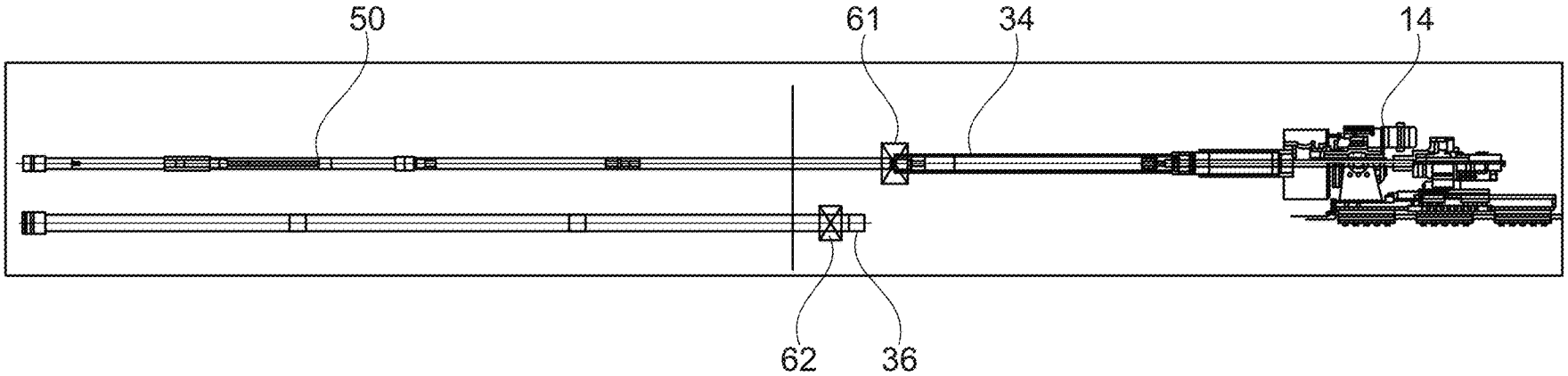
Figure 11:
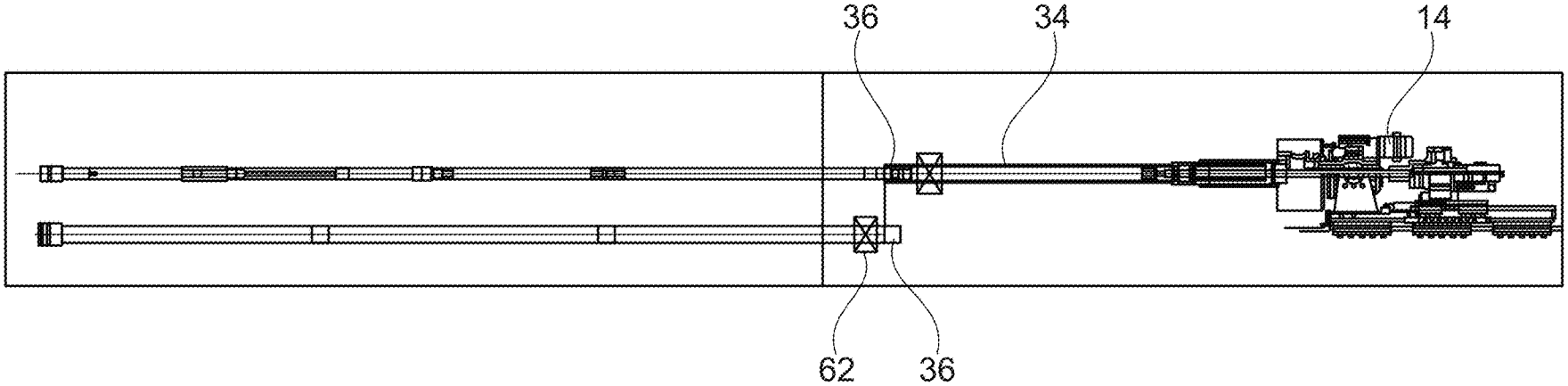
Figure 12:
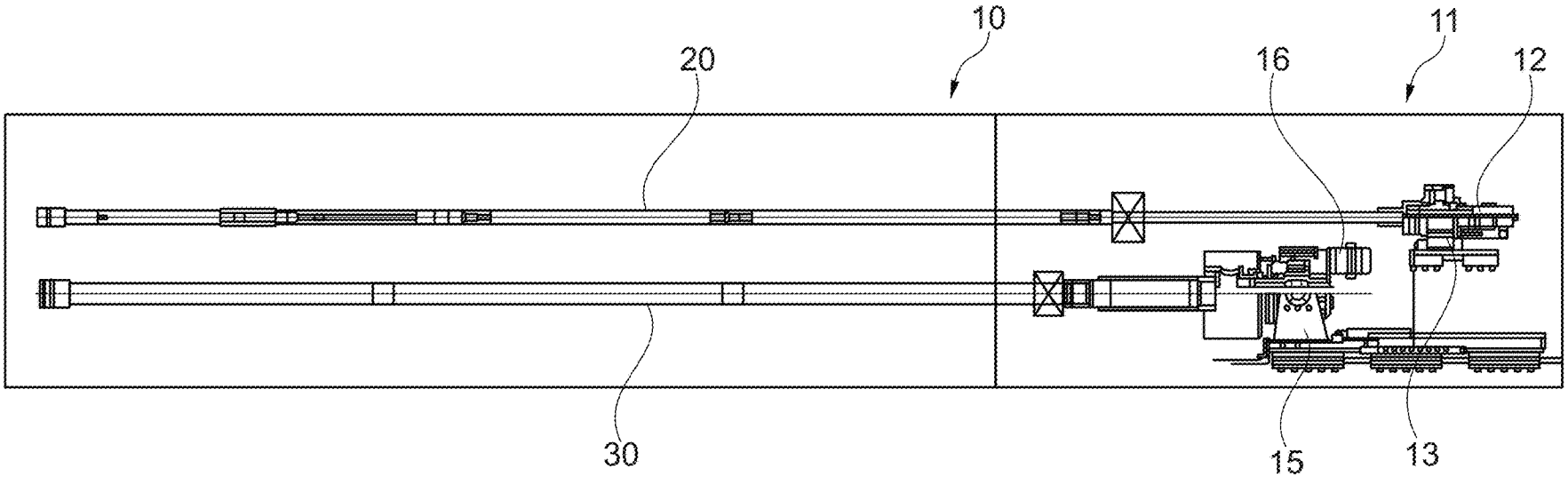

After being screwed to the inner rod 20, the first collet chuck 61 can be detached, such that the new outer rod element 34 can also be screwed onto the outer rod 30 by the second rotary drive 14, which outer rod is continuing held by the second collet chuck 62, as shown in FIGS. 10 to 12.

When screwing the new outer rod element 34 onto the existing outer rod 30, too, the first rotary drive 12 is moved together with the distal portion of the inner rod 30 towards the ground 5 and in particular the bottom of the borehole 7 again. Here, this axial displacement movement is taken up by the telescopic connecting unit 50 again, such that this displacement movement does not have an effect on the distal end of the inner rod 20 comprising the radial connecting apparatus 44. The inner pipe 52 and the outer pipe 54 of the connecting unit 50 are pushed into one another. The second collet chuck 62 can be detached again after the screwing.

FIG. 12 illustrated the state of the drilling assembly 10 with the lengthening of the inner rod 20 and the outer rod 30. The lengthening process can be repeated as often as necessary for obtaining a desired length of the inner rod 20 and the outer rod 30. In reverse, it can also be processed to disassemble the individual rod elements 24, 34 again.

The invention claimed is:

1. A drilling assembly for earth or rock drilling, comprising an inner rod which comprises, at a distal end of the inner rod facing the ground, an inner drilling tool for removing ground material, a proximal end of the inner rod being configured to be connected to a rotary drive for transmitting a drilling torque, a tubular outer rod which surrounds the inner rod and comprises, at a distal end of the outer rod, an annular drill bit for removing ground material, and an impact unit, which is arranged on the inner rod in the region of the distal end and is configured to exert axially directed impacts on the inner drilling tool, wherein, in the region of the distal end of the inner rod, a radial connecting apparatus is arranged and configured between the inner rod and the outer rod, which connecting apparatus allows torque to be transmitted from the rotationally driven inner rod to the drill bit of the outer rod, wherein a telescopic connecting unit is arranged on the inner rod and is configured to allow torque to be transmitted between the distal end of the inner rod and the proximal end of the inner rod, and to allow axial displacement between the distal end of the inner rod and the proximal end of the inner rod.

2. The drilling assembly according to claim 1, wherein the radial connecting apparatus is arranged behind the impact unit in a drilling direction.

3. The drilling assembly according to claim 1, wherein the telescopic connecting unit is arranged in front of the impact unit in a drilling direction.

4. The drilling assembly according to claim 1, wherein the impact unit can be operated by a pressurized fluid.

5. The drilling assembly according to claim 4, wherein the inner rod comprises an inner channel, through which the pressurized fluid can be conducted to the impact unit.

6. The drilling assembly according to claim 1, wherein the tubular outer rod is arranged to be coaxial with the inner rod at a radial distance, wherein an annular channel is formed for discharging removed ground material by means of a pressurized fluid emerging from the impact unit.

7. The drilling assembly according to claim 1, wherein the radial connecting apparatus comprises radially directed catches.

8. The drilling assembly according to claim 1, wherein the telescopic connecting unit comprises an inner pipe for attachment to a proximal or distal portion of the inner rod and an outer pipe, which can be displaced axially relative thereto and is mounted in a pressure-tight manner, for attachment to a proximal portion of the inner rod, and at least one axially displaceable catch element for transmitting torque is arranged between the inner pipe and the outer pipe.

9. The drilling assembly according to claim 1, wherein the inner rod and the outer rod each comprise, at their proximal end, a threaded portion, which is configured for screwing on additional rod elements.

10. The drilling assembly according to claim 1, wherein a drilling device comprising a first rotary drive for applying the drilling torque for drilling to the inner rod and a second rotary drive for applying a rotational movement for screwing on of the outer rod is arranged.

11. The drilling assembly according to claim 10, wherein an axial compensation/decoupling element for compensating for an axial change in length during screwing and/or for axially decoupling the second rotary drive from the outer rod is arranged on the second rotary drive for screwing on the outer rod.

12. The drilling assembly according to claim 10, wherein the drilling device comprises a thread having at least one first collet chuck for the inner rod and at least one second collet chuck for the outer rod.

13. A method for earth or rock drilling, the method comprising:

providing a drilling assembly according to claim 1; and lengthening or shortening the inner rod and the outer rod by attaching and/or detaching a rod element, wherein the proximal end of the inner rod is axially moved relative to the proximal end of the outer rod by an adjustment length, wherein the adjustment length is smaller than or equal to a telescoping length of the telescopic connecting unit, such that a connection via the radial connecting apparatus at the distal end of the inner rod and the drill bit at the distal end of the outer rod persists.

14. A method for earth or rock drilling, the method comprising:

providing a drilling assembly according to claim 1;

providing a drilling device comprising a first rotary drive for applying the drilling torque for drilling to the inner rod and a second rotary drive for applying a rotational movement for screwing on of the outer rod is arranged, and arranging an axial compensation/decoupling element between the second rotary drive and the outer rod, wherein, during drilling, transmission of axial impacts or vibrations from the outer rod to the second rotary drive is damped or prevented.

* * * * *